US006205968B1

(12) United States Patent
Spannbauer

(10) Patent No.: US 6,205,968 B1
(45) Date of Patent: Mar. 27, 2001

(54) INDUCTION SYSTEM, ESPECIALLY FOR USE AS AN INDUCTION PORT OF AN INTERNAL COMBUSTION ENGINE

(75) Inventor: Helmut Spannbauer, Ludwigsburg (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/446,316

(22) PCT Filed: Jun. 19, 1998

(86) PCT No.: PCT/EP98/03771

§ 371 Date: Mar. 13, 2000

§ 102(e) Date: Mar. 13, 2000

(87) PCT Pub. No.: WO98/59166

PCT Pub. Date: Dec. 30, 1998

(30) Foreign Application Priority Data

Jun. 20, 1997 (DE) ..... 197 26 327

(51) Int. Cl.[7] ..... F02M 35/10

(52) U.S. Cl. ..... 123/184.57; 181/229

(58) Field of Search ..... 123/184.57; 181/229

(56) References Cited

U.S. PATENT DOCUMENTS 2,869,670 * 1/1959 Hoffman ..... 181/229

* cited by examiner

*Primary Examiner*—Noah P. Kamen
(74) *Attorney, Agent, or Firm*—Evenson, McKeown, Edwards & Lenahan, P.L.L.C.

(57) ABSTRACT

An intake assembly with an optimal noise level, especially an intake duct for use as the manifold of an internal combustion engine. The noise level is optimized by introducing shunt resonators (16, 18) in collecting manifold of the intake duct, which is produced using a multi-shell technique. The inserted structures (16, 18) can be adhered or welded before the shells are joined, or they can be inserted in a preexisting duct formed of previously joined half shells. The shunt resonators (16, 18) require little space and can also be used for subsequently optimizing the intake ducts in the test phase, if the initial test results are acoustically unsatisfactory.

16 Claims, 2 Drawing Sheets

INDUCTION SYSTEM, ESPECIALLY FOR USE AS AN INDUCTION PORT OF AN INTERNAL COMBUSTION ENGINE

BACKGROUND OF THE INVENTION

The invention relates to an air intake system, especially for use as an air intake duct of an internal combustion engine.

Air intake systems for internal combustion engines are provided with shunt resonators especially in the area of the intake tube in order to suppress the air intake noise. In the simplest case these shunt resonators consist of a resonator chamber and a resonator neck which connects the resonator chamber to the intake tube. This basic form of the shunt resonator can be varied according to the particular application. It is conceivable to have several necks which have different lengths to make it possible to dampen air intake noises of different frequencies. The resonator chamber can have almost any desired shape.

A disadvantage in the use of shunt resonators is the space they require in the area of the air intake tube. This must be provided in the motor compartment, which is difficult due to the restricted space in the motor compartment. An approach to the solution of the problem is to be found, for example, in DE 3842248 A1. A resonator is proposed which is integrated into the housing of the air intake system. In this manner it is possible to use the dead space present in the housing as a resonator chamber. Therefore there is no need to provide additional installation space in the motor compartment.

The above-described resonator chamber must, however, be given attention structurally when establishing the configuration of the intake tube housing. It is disadvantageous that the resonator described cannot be used to improve the acoustics of an existing intake tube if the results in regard to the intake noise of the intake tube are unsatisfactory. In such a situation there often is no more room in the motor compartment for a shunt resonator, since the development of the vehicle in question is nearly completed. Thus an expensive new design may be necessary in the intake tube area.

SUMMARY OF THE INVENTION

The object of the invention is to provide a Helmholz resonator which requires little space for its installation and can also be inserted subsequently into an already existing intake tube structure. At the same time either special frequencies of the intake noise are to be damped or a broad-band damping is to be achieved.

ADVANTAGES OF THE INVENTION

The object is achieved in accordance with the invention in that an internal structure is placed in the interior of the intake tube and fastened there. This internal structure forms together with the walls of the intake tube a resonator chamber which must have at least one opening into the interior volume of the intake tube. Such an internal structure requires no additional installation space in the motor compartment. Furthermore, the possibility of retrofitting is an advantage. Above all this is easy to accomplish in air intake tubes which are manufactured by the multiple shell technique. Likewise, however, such an internal structure can be installed through the inlet and outlet openings of the intake tube. At the same time the shape of the intake tube need not be changed or need only be changed to an insubstantial extent. If the internal structure has been glued in, for example, it need only be adapted to a certain contour area of the intake tube. Advantageously, the internal structure can be configured in such a way that, after installation in the intake tube, it produces several resonator chambers of different volume. By this means different frequencies can be damped at points of concentration in the intake area.

One practical variant of the invention envisions installation of the internal structure in the interior of the air intake tube. It is arranged ahead of the air intake ducts to the cylinders. Therefore the noise damping acts on all of the air intake ducts of the air intake tube.

According to one practical embodiment of the internal structure, it is constructed of a flat component, e.g., a perforated plate, and spacers. The resonator chamber is accordingly produced between the perforated plate and the wall of the intake tube. It is advantageous in this case that the internal structure can be produced from simple semi-finished products. This leads to an economical improvement in the case of small series, e.g., in the tuning area.

An alternative variant of the internal structure envisions configuring it as an insert. It can be made in one piece with a positive influence on economy in large series production.

In accordance with a further embodiment of the invention the internal structure can have areas of differing wall thickness. If a plurality of openings are provided in an internal structure, then different neck lengths will result for the shunt resonator. The positive effect of this embodiment is a broad-band damping of the air intake noise.

On condition that the internal structure and the air intake tube are composed of the same material, the internal structure can also be welded into the air intake tube. This applies in particular to synthetic resin intake tubes, however it is also conceivable for metal intake tubes. A synthetic resin insert can be installed especially by ultrasonic welding methods. In any case other welding methods are also possible, as for example friction welding.

These and additional features of preferred embodiments of the invention will be found not only in the claims but also in the description and the drawings, and the individual features can each be realized by itself or together in the form of subcombinations in the embodiment of the invention and in other fields, and can constitute advantageous as well as independently patentable embodiments, for which protection is hereby claimed.

BRIEF DESCRIPTION OF THE DRAWINGS

Additional details of the invention are described in the drawings with reference to schematic embodiments.

DESCRIPTION OF PREFERRED EMBODIMENTS

Figure 1:
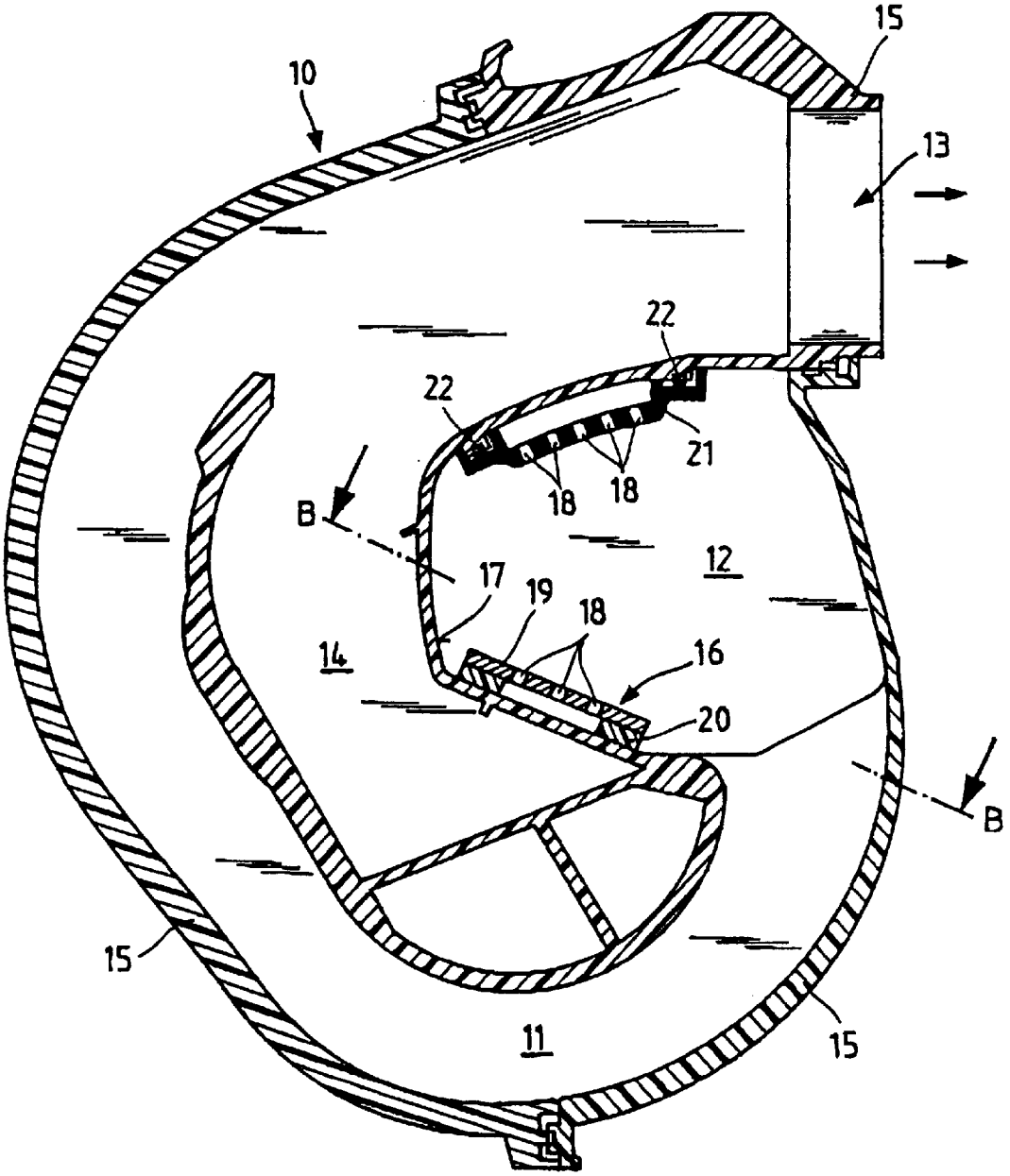
FIG. 1 shows a section through an air intake tube for an internal combustion engine with an in-line arrangement of the cylinders, with the typical spiral course of the air intake passage, taken along line A—A in FIG. 2.

In FIG. 1 an air intake tube 10 is shown in section through one of the air intake ports 11. The combustion air is fed to a manifold chamber 12 through an inlet which is not shown. The manifold chamber distributes the combustion air to the air intake ducts 11 which are connected through outlets 13 to the air inlets, which are not shown, at the cylinder end. The combustion air is fed through these to the motor. Dead spaces 14 arising in the air intake tube can be utilized for damping of the intake noise.

The air intake tube is composed of several shells 15. Before the shells are welded together, internal structures 16 can be brought into connection with internal walls 17 of the air intake tube. The internal structures have bores 18 which serve as necks for the resonator chambers formed by the internal structures. The internal structures preferably can be mounted in the manifold chamber 12 of the intake tube.

The internal structures 16 can be made of a perforated sheet metal 19 and spacers 20 which are disposed between the inner wall 17 and metal sheet 19. Alternatively, the internal structure can comprise a single insert piece 21 which is preferably welded to the internal wall 17. For this purpose welding recesses 22 must be provided on the internal wall. The welding of the shells 15 takes place after the installation of the internal structures 16.

Figure 2:
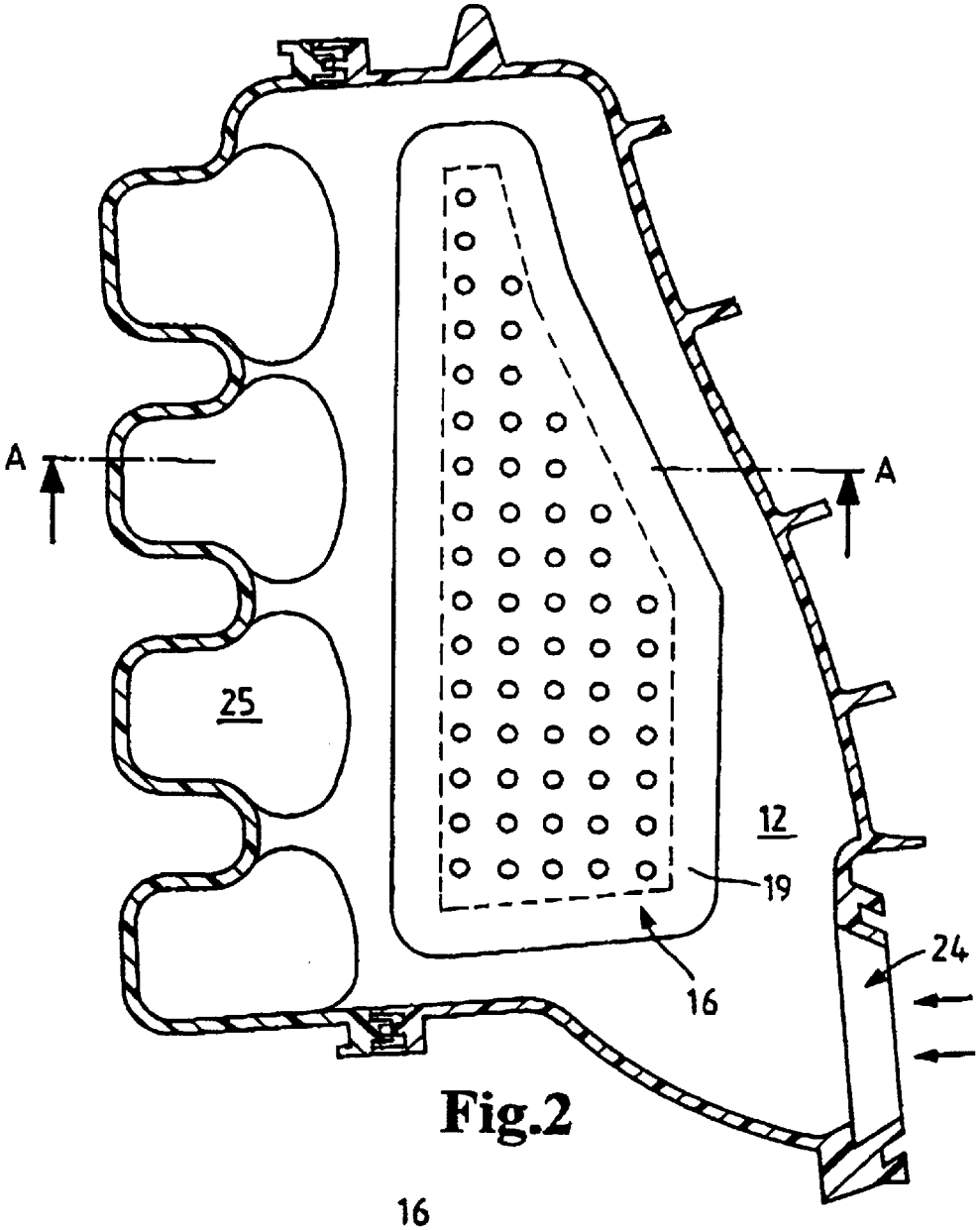
FIG. 2 shows the section B—B according to FIG. 1 taken through the manifold of the air intake tube with a view of an insert structure acting as a shunt resonator and the openings of the air intake ports.

In FIG. 2 the manifold chamber 12 is shown in a longitudinal section. It establishes the connection of an inlet 24 for the combustion air and the air intake ports 25.

The internal structure 16 is shown in plan. In this drawing the comparatively large size of the surface in comparison with the height of the internal structure (compare FIG. 1) is clearly seen. This geometry is necessary, since the cross section of the manifold chamber must not be excessively narrowed. In this manner a sufficient supply of air is delivered to the air intake ports.

Figure 3:
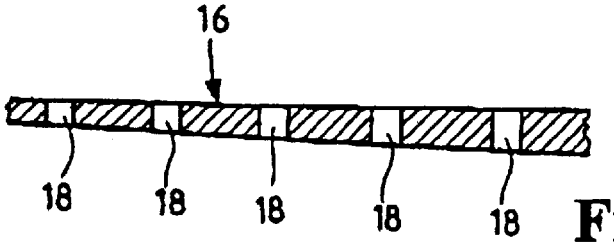
FIG. 3 shows a schematic section through the wall of an internal structure with variable wall thickness and bores which serve as necks of different length for the resonator.

FIG. 3 depicts a section through the wall section of an internal structure 16. The wall thickness of the component increases linearly in this case. The bores 18, which are made at regular intervals in the wall and serve as necks of the shunt resonator, have a varying length. In this way the shunt resonator has a broad-band effect.

Figure 4:
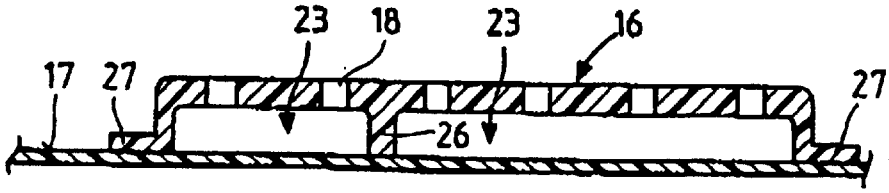
FIG. 4 shows a schematic section through an insert structure for the production of two resonator chambers of different volume.

FIG. 4 shows schematically an internal structure 16 with several resonator chambers 23. These are formed by a dividing wall 26 which rests on the inner wall 17 of the air intake tube. The internal structure can be attached to the intake tube wall via a circumferential lip 27.

What is claimed is:

1. An air intake assembly comprising:

an air intake duct for an internal combustion engine, said intake duct comprising an inlet, at least one outlet, and having cavity-forming inner walls defining a duct geometry, and at least one internal structure arranged inside said air intake duct, wherein said internal structure can be introduced into a preexisting intake duct while at least substantially retaining the duct geometry, said internal structure being attached to the cavity-forming inner walls and in cooperation with said inner walls enveloping at least one resonator chamber, and said at least one resonator chamber having at least one opening communicating between said resonator chamber and said air intake duct.

2. An air intake assembly according to claim 1, wherein said internal structure is adhesively bonded to said internal walls.

3. An air intake assembly according to claim 1, wherein said internal structure is welded to said internal walls.

4. An air intake assembly according to claim 3, wherein said internal structure is ultrasonically welded to said internal walls.

5. An air intake assembly according to claim 1, wherein said at least one opening comprises at least one bore through a wall of said internal structure.

6. An air intake assembly according to claim 1, wherein the at least one internal structure is disposed in a manifold chamber.

7. An air intake assembly according to claim 6, wherein said flat plate is a perforated sheet metal plate.

8. An air intake assembly according to claim 6, wherein said internal structure is a one-piece insert.

9. An air intake assembly according to claim 6, wherein said internal structure has areas of differing wall thickness, and at least two openings are provided in respective areas of differing wall thickness.

10. An air intake assembly according to claim 9, wherein said at least two openings comprise at least two bores through a wall of said internal structure.

11. An air intake assembly according to claim 1, wherein said internal structure comprises a flat plate and at least one spacer disposed between said flat plate and the inner wall of the cavity.

12. An air intake assembly according to claim 1, wherein said internal structure is a one-piece insert.

13. An air intake assembly according to claim 1, wherein said internal structure has areas of differing wall thickness, and at least two openings are provided in respective areas of differing wall thickness.

14. An air intake assembly according to claim 13, wherein said at least two openings comprise at least two bores through a wall of said internal structure.

15. An air intake assembly according to claim 1, wherein said air intake duct and said internal structure are formed of the same material.

16. An air intake assembly according to claim 15, wherein said air intake duct and said internal structure are both formed of the same synthetic resin material.

* * * * *